US009543098B2

(12) United States Patent
Chopade et al.

(10) Patent No.: US 9,543,098 B2
(45) Date of Patent: Jan. 10, 2017

(54) RELAY AND A METHOD FOR INDICATING A RELAY FAILURE

(71) Applicant: SCHNEIDER ELECTRIC INDUSTRIES SAS, Rueil-Malmaison (FR)

(72) Inventors: Sachin Sakharam Chopade, Singapore (SG); Yong Meng Wah, Singapore (SG); Ya Chee Yeong, Singapore (SG)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/025,079

(22) Filed: Sep. 12, 2013

(65) Prior Publication Data

US 2014/0070953 A1 Mar. 13, 2014

(30) Foreign Application Priority Data

Sep. 13, 2012 (SG) ..... 201206850

(51) Int. Cl.

| | |
|---|---|
| ***G08B 21/00*** | (2006.01) |
| ***H01H 50/08*** | (2006.01) |
| ***H01H 71/04*** | (2006.01) |
| ***H01H 73/14*** | (2006.01) |
| *H01H 50/00* | (2006.01) |
| *H01H 73/36* | (2006.01) |

(52) U.S. Cl.

CPC ..... *H01H 50/08* (2013.01); *H01H 71/04* (2013.01); *H01H 73/14* (2013.01); *H01H 50/00* (2013.01); *H01H 73/36* (2013.01); *H01H 2071/042* (2013.01)

(58) Field of Classification Search

CPC ..... H01H 50/00; H01H 50/08; H01H 73/14
USPC ..... 200/310, 313; 361/736
See application file for complete search history.

(56) References Cited

U.S. PATENT DOCUMENTS 2,713,103 A * 7/1955 Slate ..... G05G 1/105 200/316
2,944,185 A * 7/1960 Goldberg ..... H03K 29/00 313/474
3,417,196 A * 12/1968 Dreyfoos, Jr. ..... G03B 27/735 358/527

(Continued)

FOREIGN PATENT DOCUMENTS

CN 1168113 C 9/2004
CN 1320577 C 6/2007

(Continued)

OTHER PUBLICATIONS

International Search Report and Written Opinion from corresponding Singapore Application No. 201206850-8 dated Jul. 11, 2014.

(Continued)

*Primary Examiner* — Jennifer Mehmood
*Assistant Examiner* — Rufus Point
(74) *Attorney, Agent, or Firm* — Lando & Anastasi, LLP

(57) ABSTRACT

A relay and a method for indicating a relay failure may be provided, whereby the relay comprises a switch assembly capable of providing a trigger signal based on a switching status; an energisation element capable of energisation to affect the switch assembly; and a light indication for indicating a switching status of the switch assembly.

19 Claims, 5 Drawing Sheets

(56) References Cited

U.S. PATENT DOCUMENTS 3,518,386 A * 6/1970 Guberman ..... H01H 21/025 200/1 TK
4,633,240 A * 12/1986 Guim ..... H01H 71/46 200/313
4,811,157 A * 3/1989 Giordanino ..... H01H 50/08 361/142
5,041,805 A * 8/1991 Ohishi ..... H01H 89/08 335/14
5,517,381 A * 5/1996 Guim ..... H01H 1/0015 361/102
6,104,266 A * 8/2000 Tilghman ..... H01H 71/04 335/17
6,166,343 A * 12/2000 Blessitt ..... H01H 3/3021 200/400
6,864,447 B1 * 3/2005 Lipsey, II ..... H01H 73/14 200/310
7,164,564 B1 * 1/2007 Finlay, Sr. ..... H02H 3/04 361/42
7,358,838 B2 * 4/2008 Gibson ..... H01H 71/04 335/17
8,973,519 B2 * 3/2015 Bindics ..... H01H 9/16 116/285
2002/0044721 A1 * 4/2002 Bjorklund ..... G02B 6/29361 385/18
2002/0047576 A1 * 4/2002 Gurthrie ..... H05B 33/0821 315/169.3
2003/0090822 A1 * 5/2003 Richards ..... G02B 5/20 359/885
2003/0178554 A1 * 9/2003 Zak ..... 250/221
2004/0114061 A1 * 6/2004 Kimura ..... H01L 21/67011 349/45
2004/0263293 A1 12/2004 Saruwatari et al.
2005/0046526 A1 3/2005 Lipsey et al.
2007/0297112 A1 * 12/2007 Gilbert ..... G06F 1/266 361/91.5
2010/0320480 A1 * 12/2010 Rapoport ..... H01L 33/50 257/88
2011/0162946 A1 * 7/2011 Altonen ..... H01H 13/023 200/33 R
2012/0094780 A1 * 4/2012 Slaughter ..... A63B 53/00 473/316
2013/0036965 A1 * 2/2013 Bindics ..... H01H 9/16 116/286
2014/0253284 A1 * 9/2014 Peterson ..... H04M 1/185 340/3.1
2014/0298910 A1 * 10/2014 Simoni ..... G01P 15/125 73/514.32

FOREIGN PATENT DOCUMENTS

CN 100447918 C 12/2008
DE 3601941 A1 7/1987
DE 10 2007 014264 A1 9/2008
DE WO 2008113797 A1 * 9/2008 ..... H01H 9/161
EP 1059652 A1 12/2000
EP 1081732 A2 3/2001
EP 1 511 056 A2 3/2005
EP 1511056 A2 * 3/2005 ..... H01H 73/14
FR EP 0452230 A1 * 10/1991 ..... H01H 71/501
JP H06-103872 A 4/1994
WO WO 2008113797 A1 * 9/2008

OTHER PUBLICATIONS

Extended European Search Report from corresponding European Application No. 13184097.7 date Jan. 27, 2014.
English Translation of Chinese Office Action from corresponding Chinese Patent Application No. 201310414192.6 issued Apr. 24, 2015.

* cited by examiner

RELAY AND A METHOD FOR INDICATING A RELAY FAILURE

CROSS-REFERENCE TO RELATED APPLICATION

This application claims the benefit under 35 U.S.C. §119 of Singapore Patent Application No. 201206850-8 filed on Sep. 13, 2012 which is hereby incorporated herein by reference in its entirety for all purposes.

TECHNICAL FIELD

The present invention broadly relates to the field of relays and to a method for indicating a relay failure.

BACKGROUND

Electromechanical relays (EMRs) are used widely in a number of industrial applications, largely due to relatively low cost and/or small footprint when compared with other types of relays. These advantages allow a large number of relays to be deployed together to carry out complex functions, using standardized architecture for each of the various functions. The functions may include industrial control of machines, transfer machines, and other sequential control operations. Typically, such architecture is characterized by a control panel installed with a large number of relays whose contacts are easily converted from normally-open to normally-closed status.

An EMR typically comprises an electromagnetic coil with a soft iron bar, or armature. A movable contact is coupled to the armature such that the contact is held in its normal position by e.g. a spring. When the electromagnetic coil is sufficiently energized, by e.g. a user switching on the switch on the relay, a magnetic force overcomes the pulling force provided by the spring and moves the contact into an alternative position, such that the circuit is either now either broken or connected. When the electromagnetic coil is de-energized, by e.g. a user switching off the switch on the relay, the contact returns to and is held in its normal position by the spring.

Typically, systems may contain large electrical and/or electronic components which are controlled by EMRs. Such components may already provided with self-monitoring equipment and can raise "failure alarms" should the equipment malfunction. Such failure identification systems can help the maintenance crew to locate faults quickly. By locating the fault in time, the rectification process can be simplified and the maintenance crew may be able to restart the system within a short downtime.

However, EMRs are typically not equipped with such failure or fault monitoring equipment. Due to ageing of the system or any other reason, an EMR within the system may fail to execute the desired logic switch. In an application where hundreds of EMRs are connected together to form a system, any malfunction of one of the relays can lead to a complete system failure. When the system malfunctions, it can be significantly cumbersome for maintenance personnel to trace the faulty subsystem. For example, the steps for troubleshooting of the problem faced by the personnel include a first step of looking for a maintenance manual. Next, a wiring diagram would have to be examined. A trial and error method is then implemented to determine the faulty component. This trial and error method includes replacing a suspected faulty component (e.g. relay), before powering up and running the system to verify if the fault has been resolved. If the failure/fault is unresolved, the above process is repeated.

Thus, the troubleshooting process can be time consuming and can lead to prolonged system downtime if not resolved quickly. In instances where critical applications are involved, the prolonged downtime can result in catastrophic issues, causing user dissatisfactions.

Some EMRs come equipped with an ON/OFF LED indication. However, this is merely an indication that an EMR has been turned on with the magnetic coil within the EMR energised, without indicating that the desired contact switch (e.g. from Normally Open to Normally Closed) has occurred. In such instances, there is no way to quickly identify that the relay has failed to operate. In order to overcome this limitation, some EMRs are further equipped with an additional separate mechanical flag indicator, for indicating if the desired contact switching has occurred.

However, panels of EMRs are typically located in tight confined spaces where a maintenance personnel typically cannot easily access. Thus, a maintenance personnel may not be able to inspect the EMRs' mechanical flags easily. In addition, as such an EMR provides two separate information at e.g. different windows (one for indicating coil energisation and the other for indicating contact switching), the maintenance personnel has to check both windows of each EMR before determining which EMR is functioning incorrectly. This disadvantageously adds to the time taken to trouble shoot the system. Furthermore, with typically tens or hundreds of EMRs used in one panel, coupled with low light conditions due to constraints in actual work environments, the trouble shooting time taken may be significantly long.

Therefore, there is exists a need to provide a relay and a method for indicating a relay failure that seek to address one or more of the problems above.

SUMMARY

In accordance with a first aspect of the present invention, there is provided a relay comprising, a switch assembly capable of providing a trigger signal based on a switching status; an energisation element capable of energisation to affect the switch assembly; and a light indication for indicating a switching status of the switch assembly.

The light indication may further indicate an energisation status of the energisation element.

The light indication may be provided in a single window.

The relay may further comprise a light source positioned within the window, the light source adapted to be electrically powered when the energisation element is energised.

The light indication may comprise a light emitting diode (LED).

The light indication may comprise an optical filter, the optical filter being mechanically movable to alter the light indication based on the switching status.

The optical filter may be capable of altering a colour of the light indication when the switching status of the switch assembly is changed.

The optical filter may be movable between the light source and the window.

The relay may further comprise a movable contact of the switch assembly coupled to the optical filter, the movable contact capable of switching between at least first and second contact positions; wherein the first and second contact positions are each associated with respective switching statuses of the switch assembly; and the optical filter is configured to move in tandem with movement of the movable contact.

The relay as may further comprise a retaining means for retaining the movable contact in the first contact position as a default position.

The relay may further comprise a plurality of movable light sources for providing the light indication.

The energisation element may comprise an electromagnetic coil; wherein energisation of the electromagnetic coil comprises passage of a current through the electromagnetic coil to affect the switch assembly.

The relay may be an electromechanical relay.

In accordance with a second aspect of the present invention, there is provided a method for indicating a relay failure, the method comprising, providing a switch assembly for transmitting a trigger signal based on a switching status; providing an energisation element for affecting the switch assembly; and indicating the switching status of the switch assembly using a light indication.

The method may further comprise indicating an energisation status of the energisation means using the light indication.

The method may further comprise providing the light indication in a single window.

The step of indicating a switching status may comprise positioning a light source within the window; and electrically powering the light source when the energisation element is energised.

The light indication may comprise a light emitting diode (LED).

The step of indicating the switching status may comprise mechanically moving an optical filter to alter the light indication based on the switching status.

The altering of the light indication may comprise altering a colour of the light indication when the switching status of the switch assembly is changed.

The step of mechanically moving the optical filter may comprise moving the optical filter between the light source and the window.

The method may further comprise coupling a movable contact of the switch assembly to the optical filter, wherein the movable contact is capable of switching between at least first and second contact positions; and further wherein the first and second contact positions are each associated with respective switching statuses of the switch assembly; and moving the optical filter in tandem with movement of the movable contact.

The method may further comprise retaining the movable contact in the first contact position as a default position.

The step of indicating the switching status using a light indication may comprise using a plurality of movable light sources.

The method may further comprise providing an electromagnetic coil; and passing a current through the electromagnetic coil to affect the switch assembly.

The relay may be an electromechanical relay.

BRIEF DESCRIPTION OF THE DRAWINGS

Example embodiments of the invention will be better understood and readily apparent to one of ordinary skill in the art from the following written description, by way of example only, and in conjunction with the drawings, in which.

DETAILED DESCRIPTION

Figures 1A, 1B, 1C:
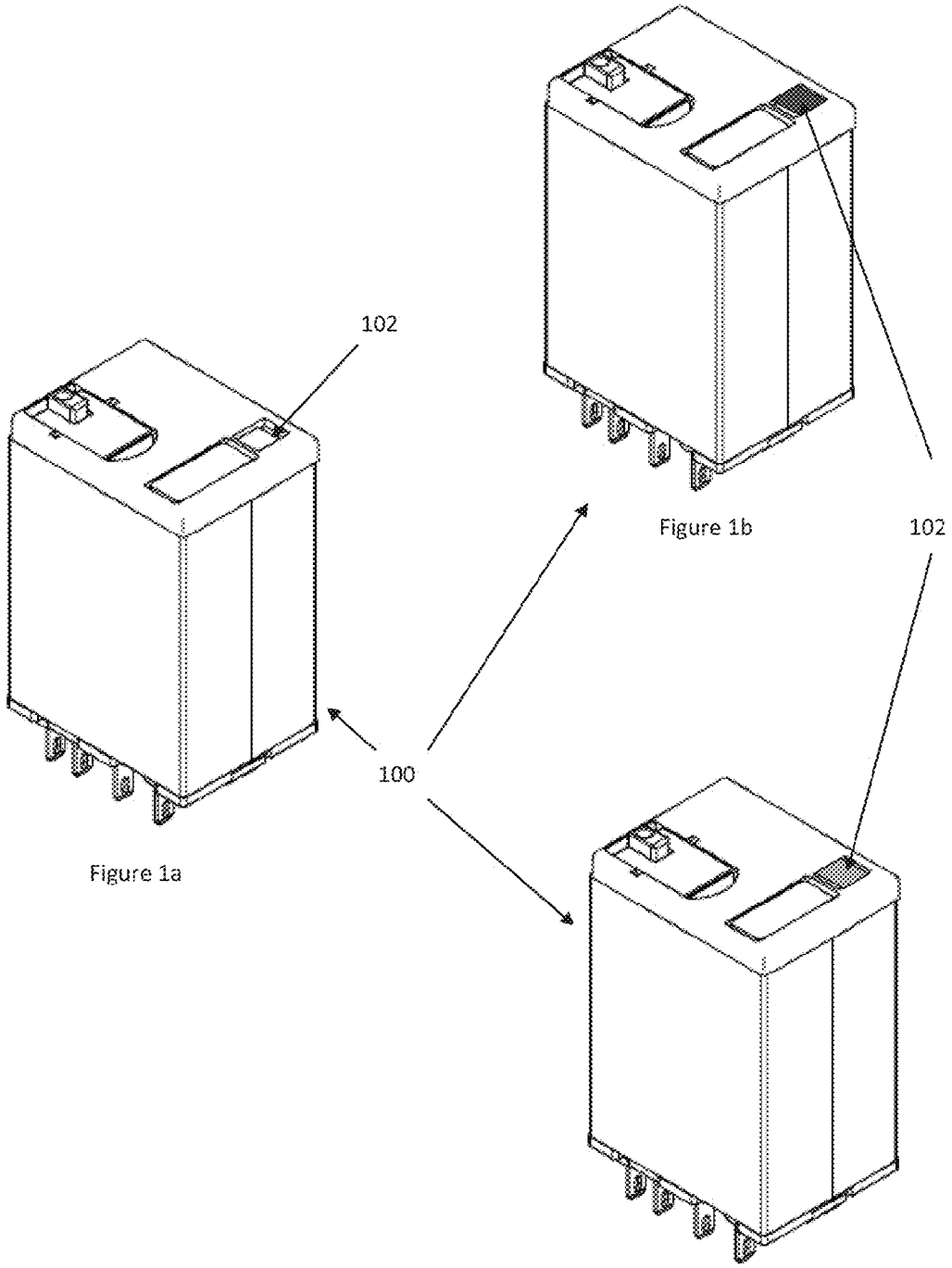
FIGS. 1*a*, 1*b* and 1*c* show perspective external views of a relay in an example embodiment.

Example embodiments described herein may provide a relay which can address one or more of the problems described above. In example embodiments, a relay is provided such that a light indication of the switching status of the relay, or more particularly of a switch assembly of the relay, can be displayed at e.g. a window, and visually observed by a user. In some embodiments, this indication may be provided by an illuminated light source (e.g. a Light Emitting Diode (LED)) such that when a desired switch of the relay has occurred, the light source is illuminated to show a first colour. If the relay is not functioning correctly such that the desired switch has not occurred, a different colour may be shown. Alternatively, for example in an example embodiment with separate light indications for energisation and for switching status, non-illumination, i.e. a nil light indication, can be used for the switching status light indication to show a contrast between whether a desired switch has occurred.

In the description herein, a relay can be an energisable coil device that can include, but is not limited to, any device that can be switched/powered on and off such as an electrical relay or other electromechanical switching devices, components or parts. An energisation event of an energisable coil device can include, but is not limited to, an electrical powering on/off of the element and/or a mechanical switching on/off of the element.

The terms "coupled" or "connected" as used in this description are intended to cover both directly connected or connected through one or more intermediate means, unless otherwise stated.

Further, in the description herein, the word "substantially" whenever used is understood to include, but not restricted to, "entirely" or "completely" and the like. In addition, terms such as "comprising", "comprise", and the like whenever used, are intended to be non-restricting descriptive language in that they broadly include elements/components recited after such terms, in addition to other components not explicitly recited. Further, terms such as "about", "approximately" and the like whenever used, typically means a reasonable variation, for example a variation of +/−5% of the disclosed value, or a variance of 4% of the disclosed value, or a variance of 3% of the disclosed value, a variance of 2% of the disclosed value or a variance of 1% of the disclosed value.

Furthermore, in the description herein, certain values may be disclosed in a range. The values showing the end points of a range are intended to illustrate a preferred range. Whenever a range has been described, it is intended that the range covers and teaches all possible sub-ranges as well as individual numerical values within that range. That is, the end points of a range should not be interpreted as inflexible limitations. For example, a description of a range of 1% to 5% is intended to have specifically disclosed sub-ranges 1% to 2%, 1% to 3%, 1% to 4%, 2% to 3% etc., as well as individually, values within that range such as 1%, 2%, 3%, 4% and 5%. The intention of the above specific disclosure is applicable to any depth/breadth of a range.

FIGS. 1*a*, 1*b* and 1*c* show perspective external views of a relay in an example embodiment. In the example embodiment, the relay is an electromechanical relay comprising an electromagnet or electromagnetic coil. Each one of FIGS. 1*a* to 1*c* shows an electromechanical relay 100 in a different state. The relay 100 comprises a window 102 which can provide a visual light indication of the state of the relay 100. In the example embodiment, a light source such as an LED (not shown), is placed within the window 102 to provide the visual light indication of the state of the relay. In the example embodiment, the state of the relay comprises an energisation status of an electromagnetic coil of the relay 100, and/or a switching status of the relay 100.

FIG. 1*a* illustrates the electromagnetic relay 100 in a first state where no power has been supplied to the electromagnetic coil of the relay 100 such that the relay is not energized, and the relay is not capable of performing any relay-based switching. In other words, both the energisation status and switching status of the relay are "OFF". Without energisation, the LED is not electrically powered. In this state, it is observable from the nil light indication at the window 102 that the LED is not powered.

FIG. 1*b* illustrates the relay 100 in a second state where power is supplied to the electromagnetic coil such that the relay is energized. However, the relay-based switching has not been performed. This may be due to a fault, e.g. the electromagnetic coil not being energized sufficiently to affect switching of the relay, for example, the contacts of a switching assembly of the relay have not been switched. In other words, the energisation status is "ON" while the switching status of the relay is "OFF". This status can be indicative of a faulty relay. In this state, it is observable from the light indication at the window 102 that the LED is electrically powered and hence illuminated with a first colour, e.g. yellow colour.

FIG. 1*c* shows the relay 100 in a third state where power is supplied to the electromagnetic coil such that the relay is energized. The electromagnetic coil is sufficiently energized to affect switching of a switch assembly of the relay, i.e. the relay performs the desired switching. In other words, both the energisation status and switching status are "ON". In this state, it is observable from the light indication at the window 102 that the LED is electrically powered and illuminated with a second colour. In the example embodiment, when the switch assembly switches and changes a switching status, a movable optical filter (not shown) is moved between the LED and the window, such that the illuminated colour observable from the window 102 is altered to e.g. green colour. The optical filter may be coupled to the movable contacts of the switch assembly and can move in tandem with the movable contacts.

Thus, in the example embodiment, a light indication can indicate a switching status of a switch assembly of a relay. In the example embodiment, green light indicates a relay operating in normal conditions while yellow light indicates a relay that has an incorrect or not desired switching status although power is being supplied to the relay.

Figure 2A:
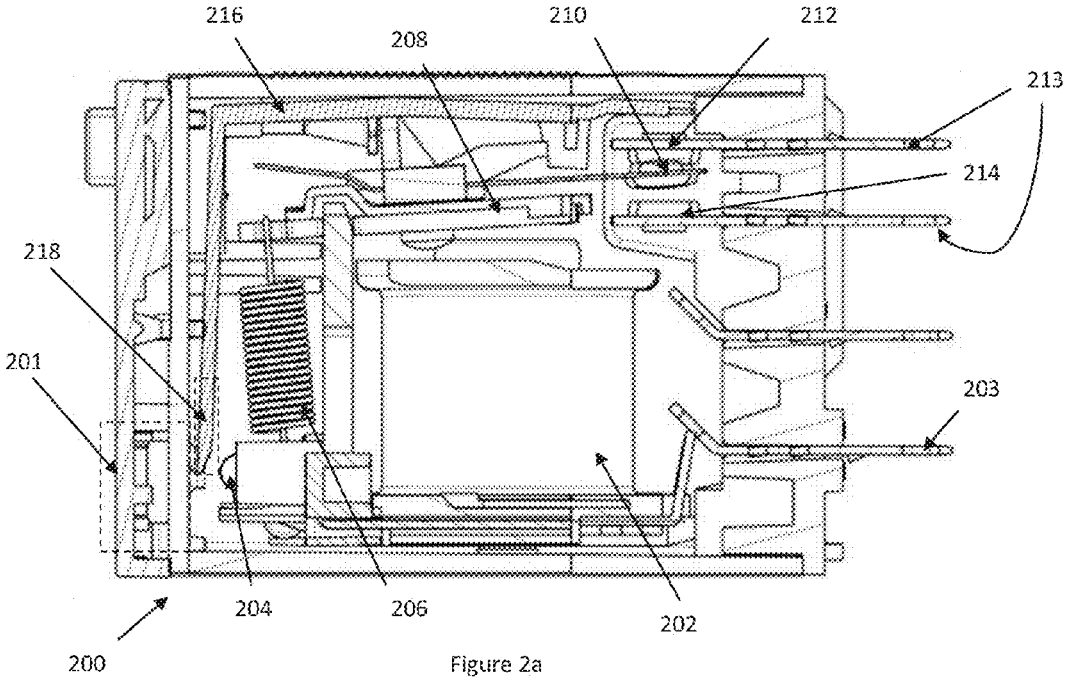
FIGS. 2*a* and 2*b* show schematic line drawings for illustrating an interior of a relay in an example embodiment.
Figure 2B:
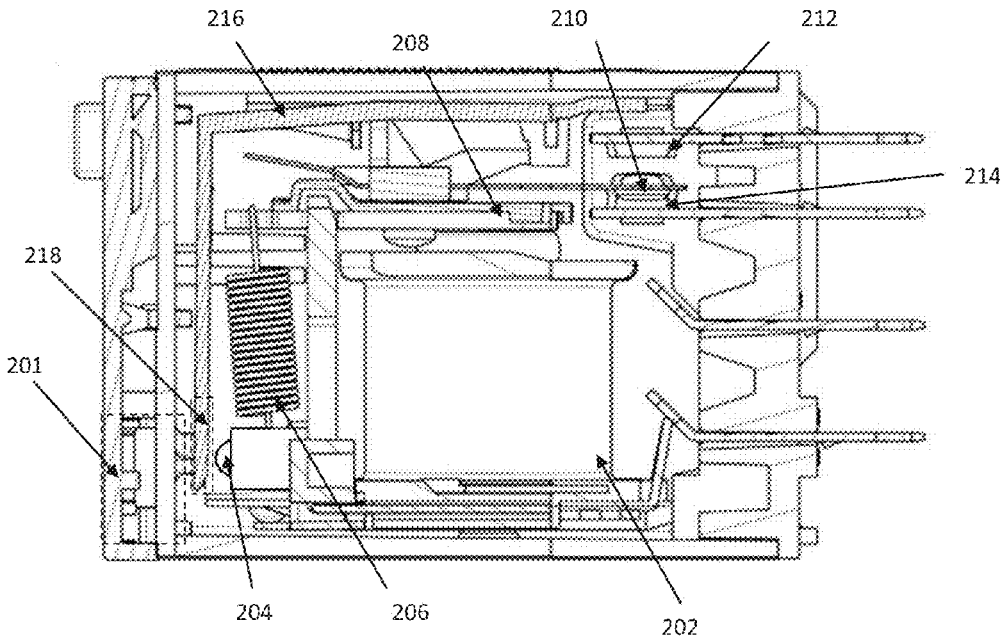

FIGS. 2*a* and 2*b* show schematic line drawings for illustrating an interior of a relay in an example embodiment. FIG. 2*a* illustrates an electromechanical relay 200 in a first and a second state that are substantially similar to the first and second states described earlier in FIGS. 1*a* and 1*b*. The relay 200 comprises an energisable coil element such as an electromagnetic coil 202 that can affect a switch assembly. The electromagnetic coil 202 may be electrically powered or energized via leads e.g. 203. The switch assembly of the relay 200 comprises an armature 208 and a movable contact arm or contact 210 that is coupled to an end of the armature 208. The switch assembly is capable of sending a trigger signal via switching between leads e.g. 213. A Normally-Closed (NC) or "closed" contact 212 is provided on one of the leads e.g. 213 while a Normally-Open (NO) or "open" contact 214 is provided on another one of the leads e.g. 213. The movable contact 210 can switch between the contact 212, 214 positions. Further, the relay 200 comprises a biasing means such as a spring 206 to bias or retain the movable contact 210 in e.g. the normally closed contact 212 position. A light-source 204 such as an LED is provided behind a window 201 to provide light indications. In addition, the relay 200 comprises a flagging assembly 216 that comprises, or couples to, a flag or optical filter 218. The flagging assembly 216 is coupled directly or indirectly to the switch assembly so as to assist in the provision of light indications based on the switching status of the switch assembly.

When no power is supplied to the electromagnetic coil 202, the electromagnetic coil 202 and the relay 200 are not energized. Without energisation of the electromagnetic coil 202, the armature 208 is not attracted by magnetic force towards the electromagnetic coil 202. The movable contact 210, which is coupled at an end of the armature 208, remains biased in a first position. In the example embodiment, the first position is maintained by the spring 206 which retains/biases the armature 208 and movable contact 210, against a "closed" contact 212 of the relay 200. In the example embodiment, the armature 208 and movable contact 210 are collectively referred to as a switch assembly.

In the example embodiment, the light source (e.g. LED) 204 is electrically connected to the electromagnetic coil 202 such that it is illuminated when the electromagnetic coil 202 is electrically powered (or energized). In the first state of no energisation, the light source 204 is not illuminated. The window 201 may be comprised of transparent or translucent material, such that illumination of the light source 204 can be observed. It can be observed by a user from the window 201 with a light indication that the LED 204 is not powered. In other words, the light source can visually indicate an "OFF" energisation status of the electromagnetic coil 202 of the relay 100.

FIG. 2*a* can also depict a second state of the relay 200 that indicates non-switching of the relay 200. When power is supplied to the electromagnetic coil 202, the electromagnetic coil 202 and the relay 200 may appear to be energised. This supply of power to the electromagnetic coil 202 results in a corresponding illumination of the light source 204. The illuminated light source 204 provides a visual light indication of an "ON" energisation status of the electromagnetic coil 202.

However, in case of e.g. insufficient power, the energisation of the electromagnetic coil 202 may generate a magnetic force that is insufficient to overcome the biasing force (generated by the spring 206 on the armature 208). Thus, the movable contact 210 remains in the first position. The user can observe from the light indication at the window 201 that a first colour of the light source 204 indicates a status of non-switching of the switch assembly.

FIG. 2*b* shows a third state of the relay 100 that indicates desired energisation and switching of the relay 200. When power is supplied to the electromagnetic coil 202, the electromagnetic coil 202 and the relay 200 are energized. With sufficient power, the energized electromagnetic coil 202 generates a sufficient magnetic force to overcome the biasing force (generated by the spring 206) exerted on the armature 208. The magnetic force thus attracts armature 208 towards the electromagnetic coil 202. The movable contact 210 is moved to a second position, where it is switched and contacts an "open" (normally open) contact 214 of the relay 200. In this third state, as the electromagnetic coil 202 is powered, the light source 204 is illuminated. Thus, the illuminated light source firstly or primarily visually indicates an "ON" energisation status of the electromagnetic coil 202 of the relay 200.

The flagging assembly 216 is coupled to the switch assembly. The flagging assembly 216 comprises the optical filter 218 disposed at one end of the flagging assembly 216. The flagging assembly 216 is arranged such that moving the movable contact 210 into the second position (i.e. against the "open" contact 214), results in a tandem or corresponding mechanical movement of the flagging assembly, such that the optical filter 218 is placed or disposed between the window 201 and the light source 204. That is, the optical filter moves in position in relation to the light source. When placed between the window 201 and the light source 204, the optical filter 218 can alter the colour of the light indication provided by the light source 204. Thus, moving the movable contact 210 into the second position can result in a light indication of a differently coloured illumination or a second colour. In this regard, the light indication can indicate a status of a switching affected at the switching assembly. In the example embodiment, the flagging assembly 216 can further comprise a latch (not shown) attached to the armature 208 of the switch assembly. The latch allows the flagging assembly 216 to be coupled to the switch assembly, and also allows the movement of the movable contact 210 from the first position to the second position to result in a tandem or corresponding mechanical movement of the optical filter 218 of the flagging assembly 216, such that the optical filter 218 is disposed between the window 201 and the light source 204. It will be appreciated by a person skilled in the art that the coupling of the flagging assembly and the switch assembly is not limited to the example embodiment described herein and other methods of coupling and/or attachment may be implemented.

Table 1 below summarises the states and exemplary associated visual light indications as described.

TABLE 1

| Relay State | Energisation Status | Switching Status | Window Display/ Light Indication |
|---|---|---|---|
| 1 | OFF | OFF | No light/Dark |
| 2 | ON | OFF | Yellow Light |
| 3 | ON | ON | Green Light |

Figure 3:
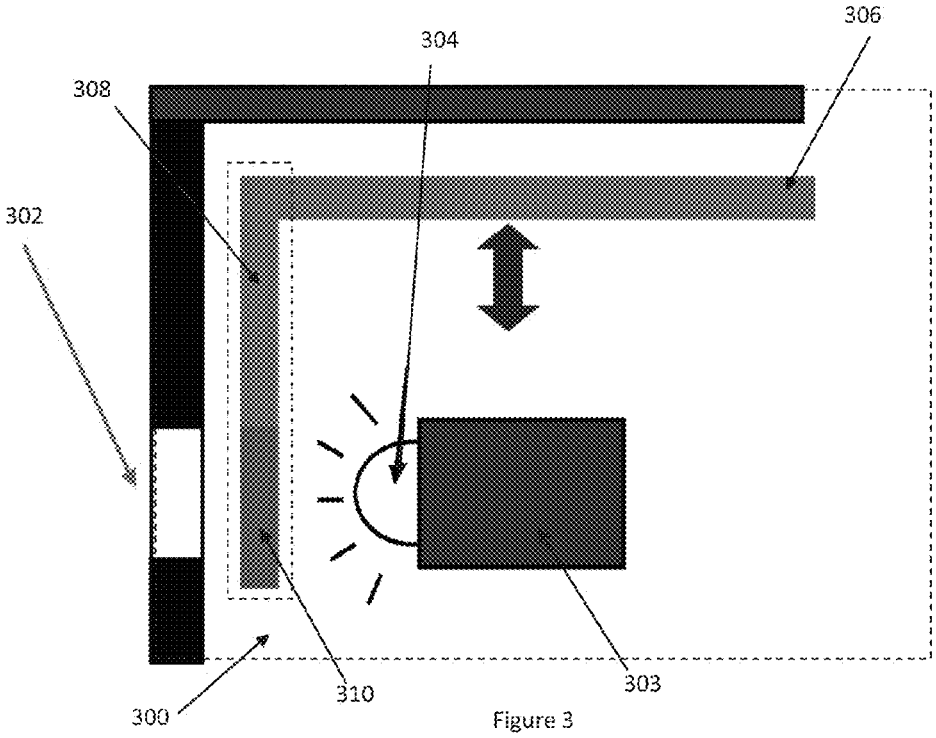
FIG. 3 is a schematic exploded drawing illustrating a flagging assembly of a relay in an example embodiment.

FIG. 3 is a schematic exploded drawing illustrating a flagging assembly of a relay 300 in an example embodiment. Only certain components of the relay are described for ease of illustration. The relay 300 in this example embodiment comprises a transparent or translucent window 302 which can allow a user to view an indication of the state of the relay 300. The relay 300 is an electromagnetic or electromechanical relay which comprises a electromagnet connection 303 and a LED light source 304. The relay 300 further comprises a switch assembly 306 arranged so as to effect movement of a flagging assembly 308. The flagging assembly 308 comprises a flag 310.

When no power is provided to the relay 300, the electromagnetic coil of the relay 300 is not energized and the LED light source 304, which is electrically connected to the electromagnet connection 303, is not illuminated. A user may thus view only a nil light indication of an unlit LED through the window 302.

When power is provided to the relay 300, the electromagnetic coil is energized. In turn, the LED light source 304, which is electrically connected to the electromagnet connection 303, is also powered and is illuminated. In the example embodiment, the LED light source 304 is capable of displaying a light indication of a first colour (e.g. yellow colour), which may be viewed through or from the window 302.

If the energisation of the electromagnetic coil is sufficient to effect switching of the switch assembly 306, a contact of the switching assembly 306 can be attracted towards the electromagnet. The switch of the switch assembly 306, as a result of the magnetic force generated by the energized electromagnetic coil 303 is associated with switching of contacts (not shown) from one position to another, effectively performing electrical switching. The flagging assembly 308 may be coupled to the switching assembly 306, such that the movement of the switch assembly 306 as a result of the magnetic force generated by the energized electromagnetic coil can be translated into the movement of the flag 310 into a space between the LED light source 304 and the window 302 such that a light indication of a second colour (e.g. green colour) may be observed. That is, the flag 310 may comprise an optical filter which can filter the yellow light indication to show green light indication.

If, for example, the energisation of the electromagnetic coil is not sufficient for the switch assembly 306 to switch or be attracted towards the electromagnetic coil to activate the electrical switching, the flag 310 stays substantially stationary. Thus, the light indication of the first colour is observed from the window 302.

Thus, the example embodiment as shown in FIG. 3 provides three different indications for three different states of the relay 300. When the electromagnetic coil is not powered (i.e. not energized), an un-illuminated light source indication is observed at the window 302. When the electromagnetic coil is sufficiently powered (energized), to affect the switch assembly such that electrical switching is achieved, a light indication of e.g. green colour is observed. When the electromagnetic coil is powered, but there is a fault e.g. the energisation is insufficient to achieve electrical switching, a light indication of e.g. yellow colour is observed.

Figure 4:
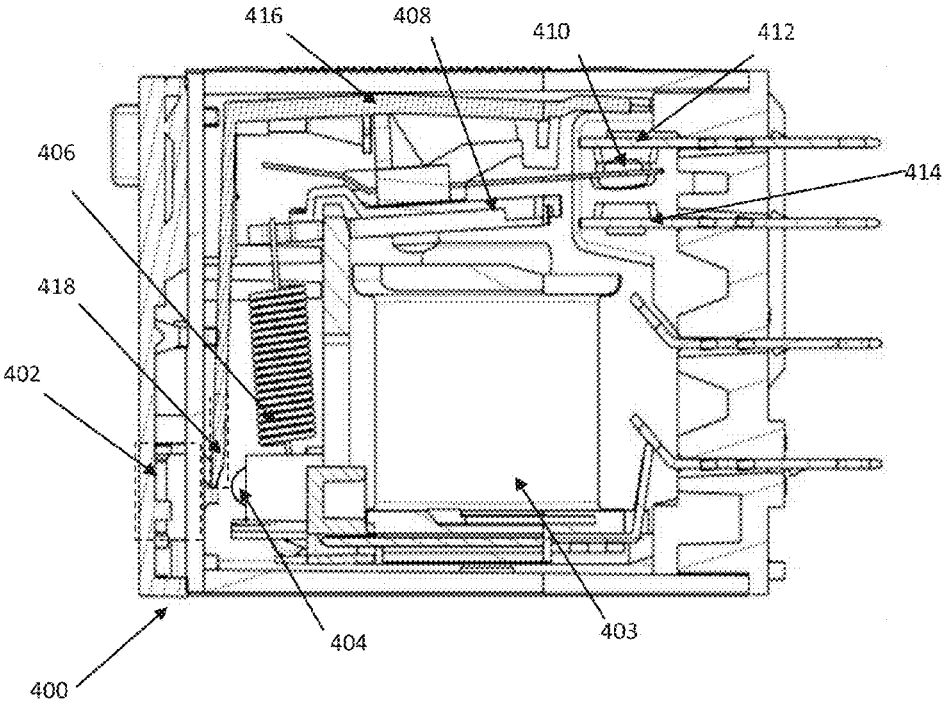
FIG. 4 shows a relay in another example embodiment.

FIG. 4 shows a relay 400 in another example embodiment. Only certain components of the relay are described for ease of illustration. The relay 400 in this example embodiment comprises a transparent or translucent window 402 which can allow a user to view an indication of the state of the relay 400. The relay 400 is an electromagnetic or electromechanical relay which comprises an electromagnetic coil 403 and a LED light source 404. The relay 400 further comprises a biasing means (e.g. spring) 406, an armature 408, and a movable contact 410 coupled to the armature 408.

When no power is provided to the relay, the electromagnetic coil 403 is not energized and the LED light source 404, which is electrically connected to the electromagnetic coil 403, is not illuminated. A user may thus view a nil light indication of an unlit LED, through the window 402. As there is no energisation of the electromagnetic coil 403, no magnetic force is generated to attract the armature 408 towards the electromagnetic coil 402. The movable contact 410, which is coupled at an end of the armature 408, remains biased against one of the contacts e.g. 412 of the relay. In the example embodiment, a first position is maintained by a spring 406 which biases the armature 408 and movable contact 410 against an "open" contact 414 of the relay. In the example embodiment, the armature 408, movable contact 410, and biasing means (spring) 406 are collectively referred to as a switch assembly.

When power is provided to the relay 400, the electromagnetic coil 403 is energized. In turn, the LED light source 404, which is electrically connected to the electromagnetic coil 403, is also powered and is illuminated. In the example embodiment, the LED light source 404 is capable of displaying a light indication of a first colour, which may be viewed through or from the window 402. If the magnetic force generated by the electromagnetic coil 403 is insufficient to overcome the biasing force provided by the spring 406, the switch assembly does not move, and the movable contact 410 remains connected and biased against the "open" contact 414 of the relay.

If the energisation of the electromagnetic coil 403 is sufficient to generate a sufficient magnetic force to overcome a biasing force (generated by the spring 406), the attractive electromagnetic force attracts the armature 408 towards the electromagnetic coil 403. This movement of the armature 408 can result in a movable contact 410 (coupled to the armature 408), moving from the first position at the "open" contact 414, to a second position at the "closed" contact 412.

Further, a flagging assembly 416 may be coupled to the switch assembly such that the movement of the switch assembly, e.g. as a result of the magnetic force generated by the energized electromagnetic coil 403, can be translated into the movement of a flag 418 of the flagging assembly 416 into a space between the LED light source 404 and the window 402. The flag 418 may comprise an optical filter which can filter the first light indication to show a second light indication.

Thus, the example embodiment as shown in FIG. 4 provides three different indications for three different states of the relay 400. When the electromagnetic coil 403 is not powered (i.e. not energized), an un-illuminated light source indication is observed at the window 402. When the electromagnetic coil 403 is sufficiently powered (energized), to affect the switching assembly such that electrical switching is achieved, a second light indication (e.g. green colour) is observed. When the electromagnetic coil 403 is powered, but for example is insufficient to achieve electrical switching, an unfiltered first light indication (e.g. yellow colour) is observed.

While it has been described for the switching and energisation statuses to be both indicated in a same window, the statuses may be both shown in respective windows, e.g. using respective light sources.

Figure 5:
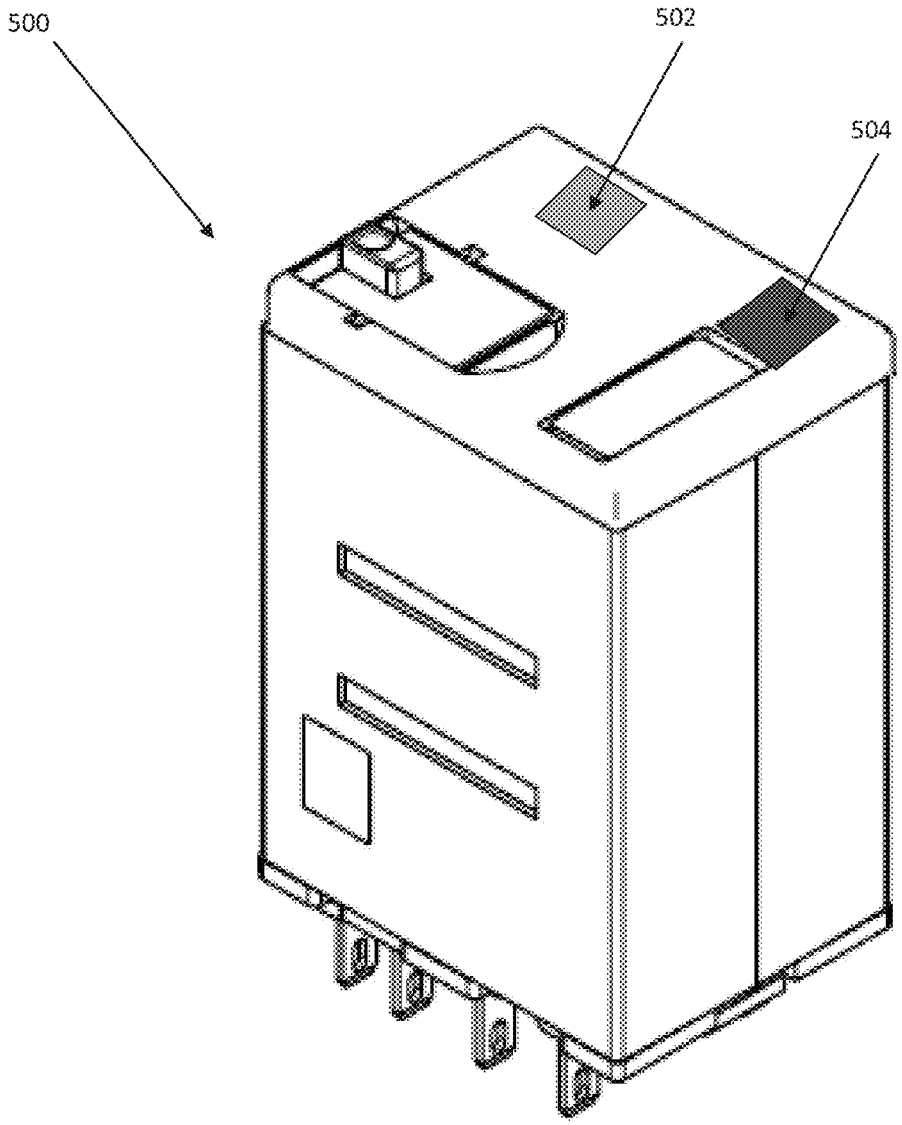
FIG. 5 shows a relay in yet another example embodiment

FIG. 5 shows a relay 500 in yet another example embodiment. The relay 500 comprises a first window 502 and a second window 504. The first window 502 can provide a light indication of the switching status of the relay 500 and the second window 504 can provide a light indication of the energisation status of the relay 500 (i.e. either energised or not). In the example embodiment, the first window 502 may show a first light indication to indicate successful electrical switching of the switch assembly (not shown) and a second light indication to indicate a faulty and/or no switching of the switch assembly. It will be appreciated that the operations of the switch and flagging assemblies previously described in e.g. FIGS. 2*a* and 3 may be implemented in a substantially similar manner in the relay 500 e.g. for showing the light indication at the window 502.

Figure 6:
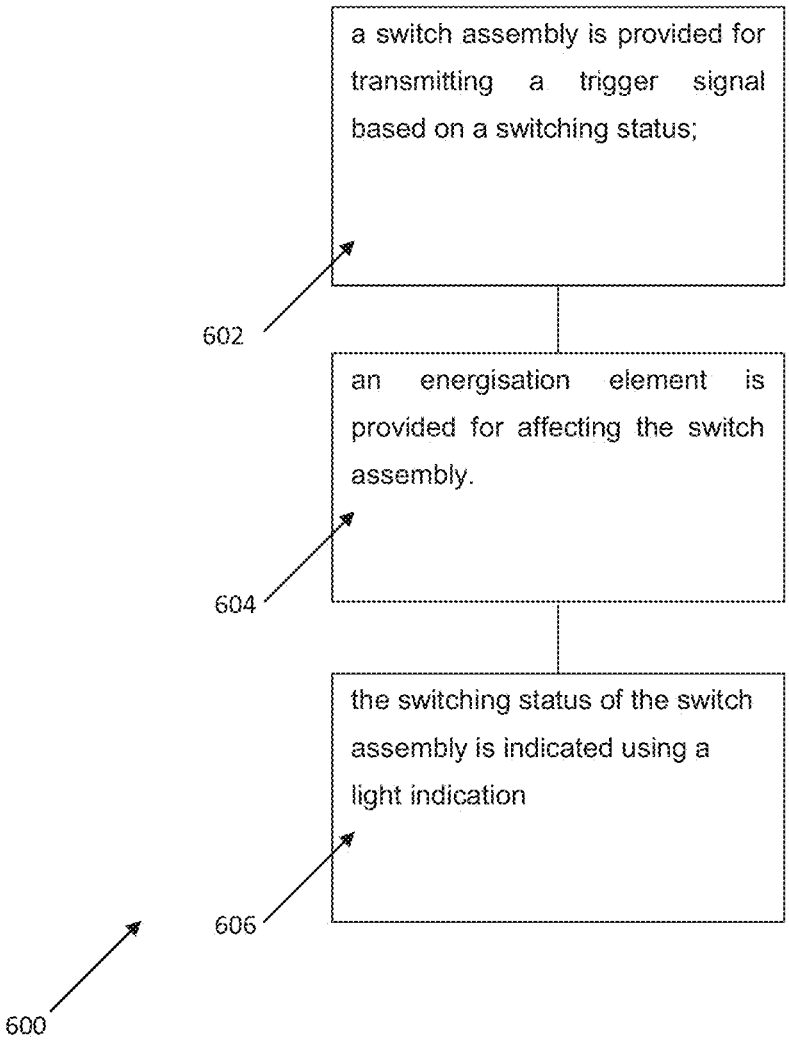
FIG. 6 is a schematic flow chart for illustrating a method for indicating a relay failure in an example embodiment.

FIG. 6 is a schematic flow chart 600 illustrating a method for indicating a relay failure in an example embodiment. At step 602, a switch assembly is provided for transmitting a trigger signal based on a switching status. At step 604, an energisation element is provided for affecting the switch assembly. At step 606, the switching status of the switch assembly is indicated using a light indication.

Example embodiments can provide a relay whereby an indication of a switching status of the relay can be displayed at e.g. a window, and visually observed by a user. This can allow a maintenance personnel to easily identify a faulty relay, or a fault, by observing the window or light indication to determine if the relay has switched correctly.

In some embodiments, the light indication may be provided by an illuminated light source (e.g. an LED) such that when a desired switch of the relay has occurred, the LED is illuminated to show one colour. If the relay is not functioning correctly, e.g. such that the desired switch has not occurred, a different colour may be observed. This is further advantageous as it allows the maintenance personnel to more quickly identify a faulty relay or a fault, especially if the relay is located in a dimly lit or unlit area. This is also advantageous in the event if the maintenance personnel is required to inspect a plurality of relays in a panel. Further, in instances where the relay is positioned in a confined space such that the maintenance personnel has only an oblique view of the window, an illuminated status indicator can be more readily/easily observed.

In some embodiments, the light indication may further indicate an energisation status of the energisation means. For example, the indication may show a first colour to indicate a switching status of the relay while also indicating an energisation status of the relay. The indication may therefore be displayed or provided in a single window for observation by a user. This can advantageously allow a user to observe the energisation and switching status of the relay by looking only at a single location (e.g. window) of the relay. This can result in the identification of faulty relays, particularly from a panel of numerous relays, more quickly.

In an example embodiment, the optical filter can alter the light indication provided by the illuminated LED from e.g. red to green or yellow to green. It will be appreciated that any kind of optical filter which can alter the colour of the LED light indication may also be implemented. The optical filter may even be an opaque filter, e.g. of a different colour as the surrounding face of the relay. Thus, when there is sufficient energisation of the relay resulting in the movement of the switching assembly, a solid-coloured, opaque flag may be moved into position to provide the visual indication. This opaque flag should preferably be of a different colour from the face of the relay where the window is made available, to allow easy viewing. For example, if the face of the relay where the window is situated is white, a red flag can be used to provide the visual indication as it can provide sufficient contrast with the white background. Thus, the three different indications for three different states of the relay are provided. When the electromagnetic coil is not powered (i.e. not energized), an un-illuminated light indication of e.g. is observed at a window. When the electromagnet is sufficiently powered (energized) to affect the switching assembly such that electrical switching is achieved, an e.g. red-coloured flag is observed. When the electromagnetic coil is powered, but is insufficient to achieve electrical switching, an illuminated yellow light indication is observed.

In another embodiment, instead of moving an optical filter into position between the light source and window such that it filters the light source upon successful switching by the switch assembly, the optical filter may instead start from the position to perform filtering when the switch assembly is not switching, and moved away from between the light source and the window such as not to perform filtering, upon successful switching by the switch assembly.

In some example embodiments, the flag is mechanically moved between the light source and the window when the switching status is changed. It will be appreciated that any kind of mechanical movement arising from switching status changes, which can result in a change in the visual indication, can be implemented. For example, the flag assembly may mechanically move the viewing window between two light sources such that a different indication is observed based on the state of the relay. Alternatively, the relay may comprise two or more light sources which may be mechanically moved into position behind a stationary window, based on the status of the relay. This can comprise the plurality of light sources (with e.g. different colours) being mechanically movable (e.g. by a flagging assembly) over a power supply contact point such that a different light indication is shown depending on which light source is being powered.

It will also be appreciated that while the example embodiments described above relate to a relay with an electromagnet as the energisation element, other types of relays may also be used that comprise other forms of energisation elements.

While it has been described in the example embodiments that the relay failure may be a result of insufficient energisation of an electromagnet, it will be appreciated that any other type of relay failure may be similarly identified. For example, the relay may have a broken armature, or the movable contact is not properly coupled to the armature such that despite sufficient energisation of the electromagnet, the switching status of the relay is not accordingly switched.

With reference to the example embodiments, the inventors have recognized that by using mechanically movable parts to provide indications, re-engineering of relays to incorporate more electrical parts may be advantageously avoided.

It will be appreciated by a person skilled in the art that other variations and/or modifications may be made to the specific embodiments without departing from the spirit or scope of the invention as broadly described. The present embodiments are, therefore, to be considered in all respects to be illustrative and not restrictive.

The invention claimed is:

1. A relay comprising:

a switch assembly configured to provide a trigger signal based on a switching status;

an energization element configured to energize the switch assembly to change a switching status of the switch assembly; and a light indication configured to indicate the switching status of the switch assembly, the light indication including an optical filter, the optical filter controlled by the switch assembly to alter the light indication based on the switching status;

wherein the energization element is coupled to the switch assembly and the switch assembly is coupled to the optical filter such that energization of the energization element activating the switch assembly causes the optical filter to move automatically.

2. The relay of claim 1, wherein the light indication is further configured to indicate an energization status of the energization element.

3. The relay of claim 2, wherein the light indication is provided in a single window.

4. The relay of claim 3, further comprising a light source positioned within the single window, the light source adapted to be electrically powered when the energization element is energized.

5. The relay of claim 4, wherein the light indication comprises a light emitting diode (LED).

6. The relay of claim 1, wherein the optical filter is configured to alter a color of the light indication when the switching status of the switch assembly is changed.

7. The relay of claim 4, wherein the optical filter is configured to be movable between the light source and the single window.

8. The relay of claim 1, further comprising:

a movable contact of the switch assembly coupled to the optical filter, the movable contact being configured to switch between a first contact position and a second contact position, wherein each of the first contact position and the second contact position is associated with a respective switching status of the switch assembly, and wherein the optical filter is configured to move in tandem with movement of the movable contact.

9. The relay of claim 8, further comprising a retaining device configured to retain the movable contact in the first contact position, wherein the first contact position is a default position.

10. The relay of claim 1, further comprising a plurality of movable light sources configured to provide the light indication.

11. The relay of claim 1, wherein the energization element comprises an electromagnetic coil; and wherein energization of the electromagnetic coil comprises passage of a current through the electromagnetic coil to affect the switch assembly.

12. The relay of claim 11, wherein the relay is an electromechanical relay.

13. A method for indicating a relay failure, the method comprising:

providing a switch assembly for transmitting a trigger signal based on a switching status;

providing an energization element for affecting the switch assembly to change a switching status of the switch assembly; and indicating the switching status of the switch assembly using a light indication, wherein indicating the switching status includes controlling, by the switch assembly based on energization of the energization element to change a state of the switch assembly, an optical filter coupled to the switch assembly to automatically move to alter the light indication based on the switching status.

14. The method of claim 13, further comprising indicating an energization status of the energization element using the light indication.

15. The method of claim 13, further comprising providing the light indication in a single window, and wherein indicating the switching status of the switch assembly using a light indication further includes positioning a light source within the single window, and electrically powering the light source when the energization element is energized.

16. The method of claim 15, wherein altering the light indication includes altering a color of the light indication when the switching status of the switch assembly is changed.

17. The method of claim 13, wherein controlling the optical filter includes moving the optical filter between the light source and the single window.

18. The method of claim 13, further comprising:

coupling a movable contact of the switch assembly to the optical filter, wherein the movable contact is capable of switching between a first contact position and a second contact position, wherein each of the first contact position and the second contact position is associated with a respective switching status of the switch assembly; and moving the optical filter in tandem with movement of the movable contact.

19. The method of claim 13, wherein indicating the switching status of the switch assembly using a light indication further includes using a plurality of movable light sources.

* * * * *